United States Patent [19]

Naruo et al.

[11] Patent Number: 4,506,251

[45] Date of Patent: Mar. 19, 1985

[54] SHEATHED RESISTANCE HEATER

[75] Inventors: Noboru Naruo; Hidekata Kawanishi, both of Osaka, Japan

[73] Assignee: Matsushita Electric Industrial Co., Ltd., Japan

[21] Appl. No.: 459,526

[22] PCT Filed: May 17, 1982

[86] PCT No.: PCT/JP82/00172

§ 371 Date: Jan. 18, 1983

§ 102(e) Date: Jan. 18, 1983

[87] PCT Pub. No.: WO82/04172

PCT Pub. Date: Nov. 25, 1982

[30] Foreign Application Priority Data

May 19, 1981 [JP] Japan ..... 56-76231
May 20, 1981 [JP] Japan ..... 56-77181

[51] Int. Cl.[3] ..... H01C 1/03

[52] U.S. Cl. ..... 338/238; 174/102 P; 219/544; 219/552; 338/243; 338/274; 501/108

[58] Field of Search ..... 338/234, 238, 239, 240, 338/241, 242, 243, 273, 274; 219/530, 540, 541, 544, 552, 553; 252/500, 521; 29/614; 174/102 P, 118; 106/58; 501/108, 112

[56] References Cited

U.S. PATENT DOCUMENTS

| | | | |
|---|---|---|---|
| 2,932,577 | 4/1960 | Shaw et al. | 501/109 X |
| 3,201,738 | 8/1965 | Mitoff | 338/238 |
| 3,477,058 | 11/1969 | Vedder et al. | 338/238 |
| 3,622,755 | 11/1971 | Vedder | 219/544 |
| 3,623,921 | 11/1971 | Behringer et al. | 501/108 X |
| 4,087,777 | 5/1978 | Classen et al. | 338/238 |
| 4,280,932 | 7/1981 | Borom et al. | 252/521 |
| 4,376,245 | 3/1983 | Lindskog et al. | 219/552 |

FOREIGN PATENT DOCUMENTS

| | | | |
|---|---|---|---|
| 54-150751 | 11/1979 | Japan . | |
| 55-90094 | 7/1980 | Japan . | |
| 691659 | 5/1953 | United Kingdom | 174/118 |

*Primary Examiner*—Volodymyr Y. Mayewsky
*Attorney, Agent, or Firm*—Lowe, King, Price & Becker

[57] ABSTRACT

This invention relates to a sheathed resistance heater which comprises a heating wire (2) received in a metallic pipe 3 and electrically insulating powder (4) packed in the pipe. A metallic powder of the specific type is added to the electrically insulating powder (4), by which the heating wire (2) has a prolonged life by suppressing metal components in the wire from evaporating, the heater being widely applicable for domestic and industrial purposes.

5 Claims, 13 Drawing Figures

SHEATHED RESISTANCE HEATER

TECHNICAL FIELD

This invention relates to a sheathed resistance heater of the type which comprises a heating wire received in a metal pipe and an electrically insulating powder packed in the metal pipe by which the resistance heater has a prolonged life and can be maintained at a high level of insulation resistance in a working condition after having been used over a long term.

BACKGROUND ART

Sheathed or shielded resistance heaters have widely been used in many fields as heating parts because of their very excellent performance, quality and convenience. The commercial range of the heaters has now increased including not only domestic electric articles, but also specific applications such as in various industries, space developments and atomic power services. Among various classes of the sheathed electric heaters, sheathed heaters for high temperature purposes will more and more increase in applications.

Upon reviewing the performance and quality of sheathed resistance heaters in a world-wise sense, it will be found that they have defects in that the insulation resistance in a working condition (hereinafter referred to as insulation resistance under self-heating conditions) lowers as a function of time, coupled with another disadvantage in that it takes only a short time before breakage of the heating wire.

DISCLOSURE OF THE INVENTION

The present invention contemplates to provide a sheathed resistance heater in which there is used an electrically isnulating powder which contains a specific type of a powder therein whereby the life before breakage of the heating wire is prolonged and the heater exhibits a high insulation resistance when measured under working or self-heating conditions after long-term use.

BRIEF DESCRIPTION OF THE DRAWINGS

FIGS. 2 through 13 refer to embodiments of the present invention, in which FIGS. 2, 5, 8 and 11 are, respectively, characteristic graphs showing the relation between the total test period and the insulation resistance under self-heating conditions, FIGS. 3, 6, 9 and 12 are characteristic graphs showing the relation between the amount of metallic powder and the insulation resistance under self-heating conditions; and FIGS. 4, 7, 10 and 13 are characteristic graphs showing the relation between the amount of metallic powder and the life.

BEST MODE FOR CARRYING OUT THE INVENTION

Embodiments of the present invention are described with reference to the accompanying drawings.

Figure 1:
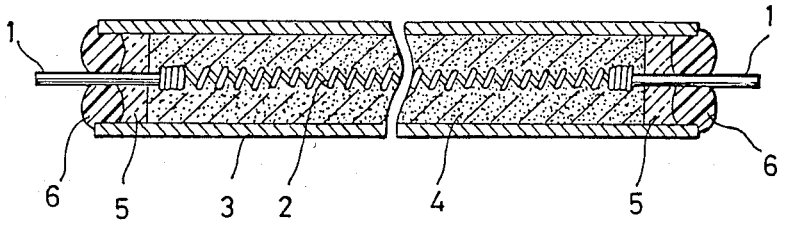
FIG. 1 is a sectional view of a conventional sheathed resistance heater.

In general, a sheathed resistance heat comprises, as particularly shown in FIG. 1, a coil-like heating wire 2 provided with terminal bars 1 at opposite ends thereof, a metal pipe 3 receiving the wire therein, an electrically insulating powder 4 such as electrofused magnesia, electrofused silica, electrofused alumina and the like filled up in the metal pipe 3, and optionally, a glass 5 and a heat-resistant resin 6 sealing opposite ends of the metal pipe 3 therewith.

We have paid particular attention to the electrically insulating powder 4 and made extensive studies on the powder.

EXAMPLE 1

An electrofused magnesia powder was used as a main component of the electrically insulating powder 4, to which were added different amounts of nickel powder and mixed together to obtained samples of electrically insulating powder 4.

The electrofused magnesia powder used had a composition indicated in Table 1.

TABLE 1

| | |
|---|---|
| MgO | 96–97 wt % |
| CaO | 0.2–0.3 wt % |
| $SiO_2$ | 2–3 wt % |
| $Al_2O_3$ | 0.4–0.5 wt % |
| $Fe_2O_3$ | 0.14–0.16 wt % |

The heating wire 2 used was a nichrome wire of the first kind having a diameter of 0.29 mm in the form of a coil having a winding diameter of 2 mm. The heating wire was connected with terminal bars 1 at opposite ends thereof.

The metal pipe 3 was a NCF 2P pipe (commercial name Incoroi 800) having a length of 413 mm, an outer diameter of 8 mm and a thickness of 0.46 mm. Into the metal pipe 3 was inserted the heating wire 2 connecting the terminal bars 1 at opposite ends thereof. Subsequently, the electrically insulating powder 4 which had been previously prepared was charged into the metal pipe 3, followed by subjecting the metal pipe 3 to steps of rolling for reduction of the diameter and annealing (1050° C., 10 minutes). The resulting metal pipe 3 had a length of 500 mm and an outer diameter of 6.6 mm. The metal pipe 3 was then sealed at opposite ends with a low melting glass 5 and a heat-resistant resin 6. Thus, sheathed resistance heaters of sample Nos. 12–17 were obtained.

It will be noted that the amount of nickel powder in the insulating powders for use in the sheathed heaters of sample Nos. 12–17 are shown in Table 2.

For comparison purposes, a conventional sheathed heater (sample No. 11) was made using, as the insulating powder 4, an electrofused magnesia powder alone having the composition indicated in Table 1.

Each of the sheathed heaters of sample Nos. 11–17 was tested in the following manner to determine its insulation and life performances.

As an initial characteristic of each of the finished samples, there was measured an insulation resistance under conditions where the metal pipe was heated up to a surface temperature of 750° C. The results are shown in Table 2.

Figure 2:
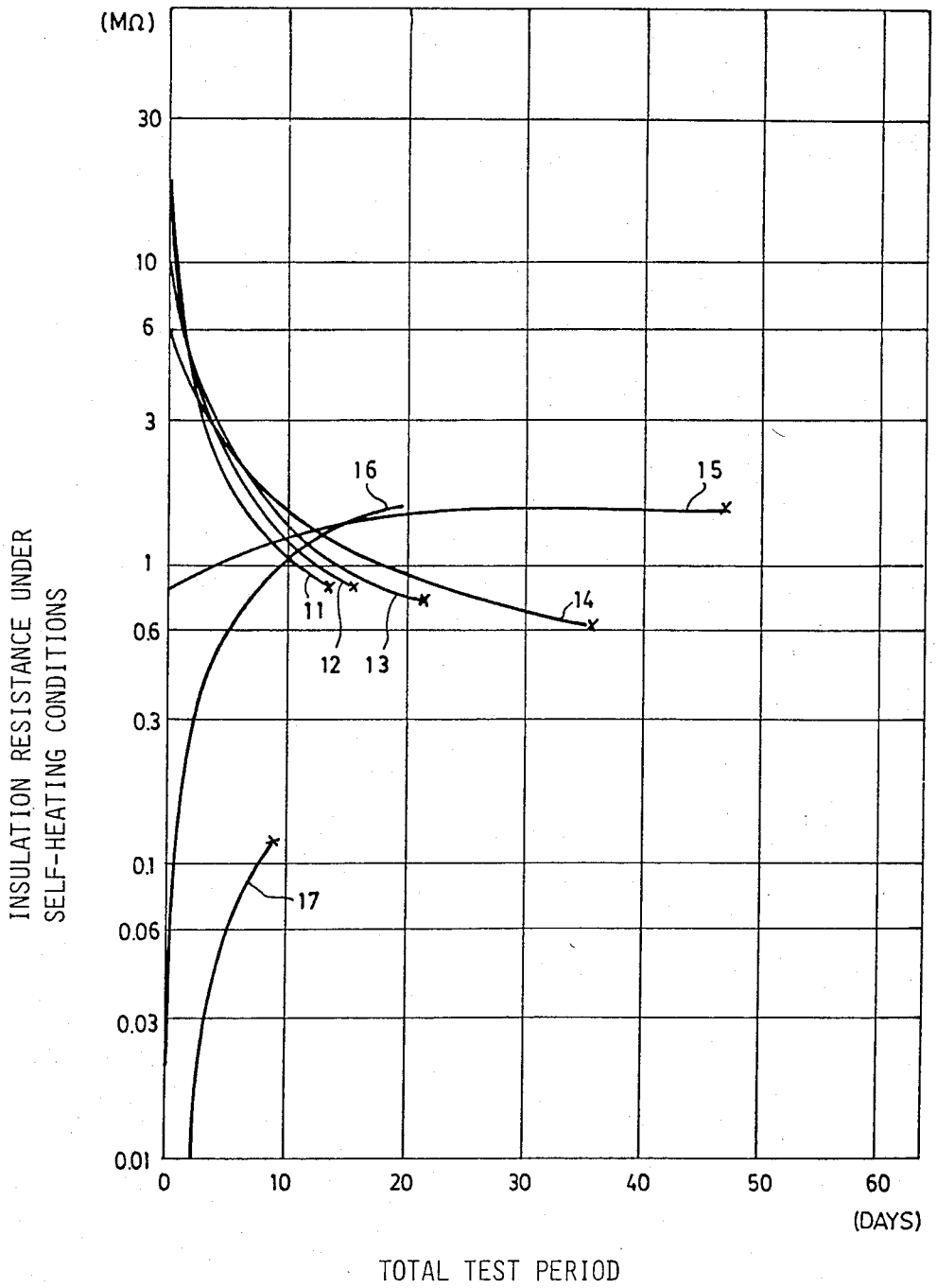

The heating wire 2 of each sample was continuously energized so that the surface temperature of the metal pipe 3 was maintained at 750° C. to determine a variation of insulation resistance under self-heating conditions. Upon measurement of the insulation resistance under self-heating conditions, the surface temperature of the metal pipe 3 was lowered down to 750° C. The variation of the insulation resistance is shown in FIG. 2. In FIG. 2, curves 11–17 show variations of the insulation resistance under self-heating conditions of the respective sheathed heaters of sample Nos. 11–17.

Figure 3:
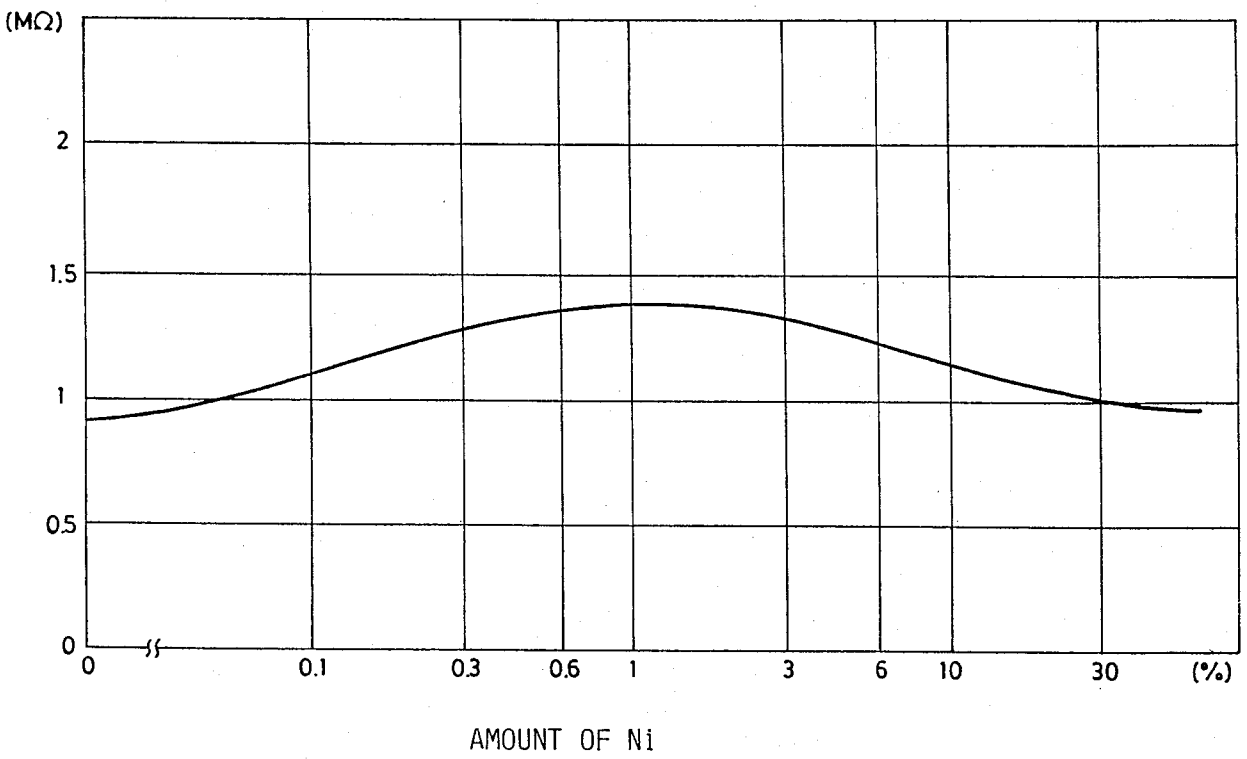

In Table 2, there are shown the values of the insulation resistance measured 11 days after commencement of the continuous energizing test. FIG. 3 shows the relation between the amount of nickel powder and the insulation resistance value under self-heating conditions 11 days after commencement of the continuous energization.

Figure 4:
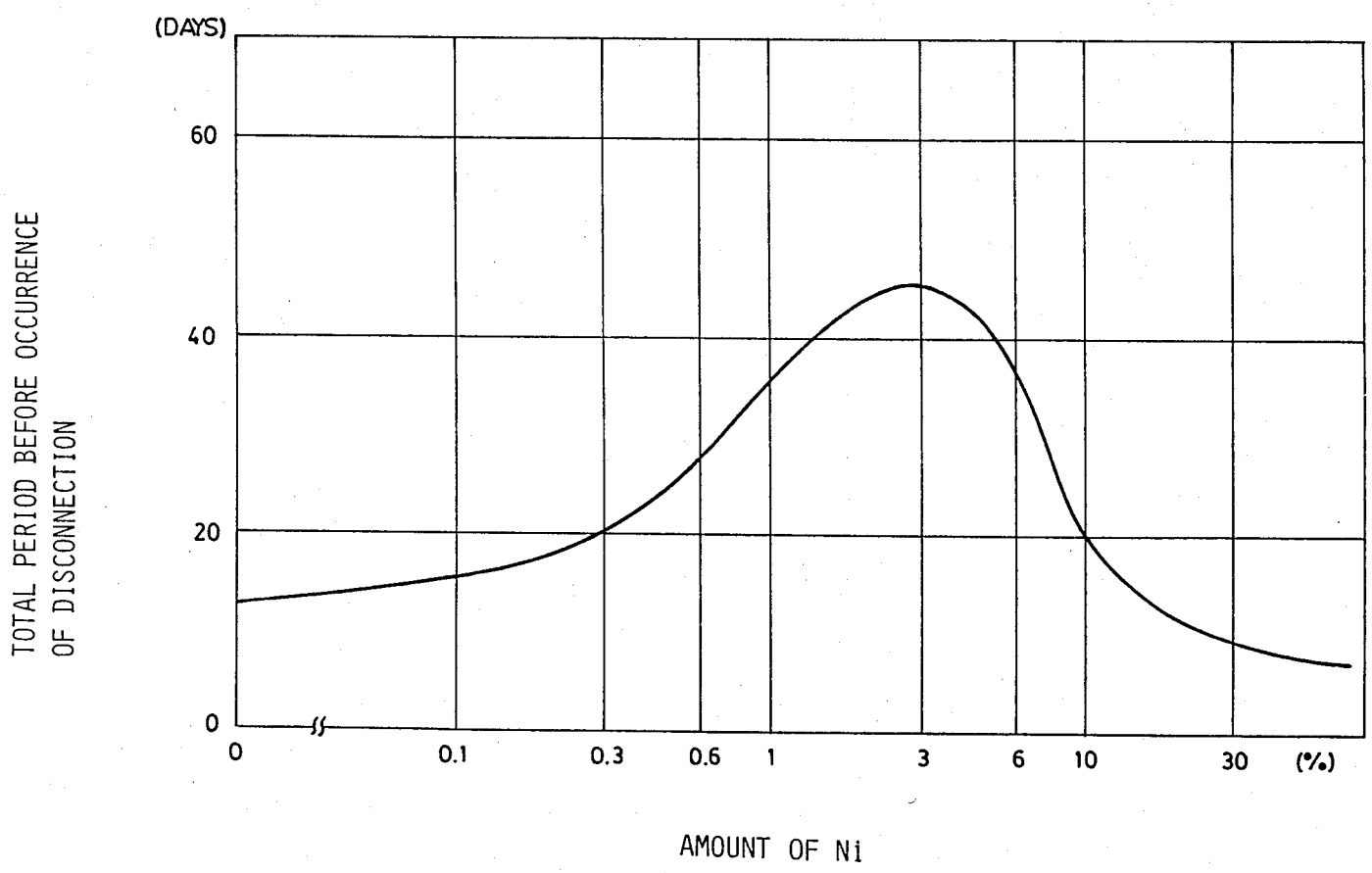

Moreover, the respective sheathed heaters of sample Nos. 11–17 were continuously energized until the heating wire was broken to determine the number of days (life) before occurrence of the breakage. The results are shown in Table 2 and the relation between the amount of nickel powder and the life is shown in FIG. 4.

TABLE 2

| Sample No. | Amount of Nickel Powder (wt %) | Initial Insulation Resistance under self-heating Conditions (Mega Ohms) | Insulation Resistance under Self-heating Conditions (Mega Ohms) | Life (Days) |
|---|---|---|---|---|
| 11 | 0.0 | 20 | 0.95 | 13 |
| 12 | 0.1 | 14 | 1.1 | 16 |
| 13 | 0.3 | 11 | 1.3 | 20 |
| 14 | 1.0 | 6 | 1.4 | 35 |
| 15 | 3.0 | 0.85 | 1.3 | 46 |
| 16 | 10.0 | 0.02 | 1.1 | 20 |
| 17 | 30.0 | <0.01 | — | 9 |

As will be apparent from Table 2 and FIG. 2, the sheathed heaters of sample Nos. 12–16 in which the amount of the nickel powder in the insulating powder is in the range of 0.1–10 wt% had almost the same level of the insulation resistance under self-heating conditions after long-term use as the known sheathed heater of sample No. 11. The sheathed heater of sample No. 17 was found to be so low in the insulation resistance that it could not stand practical use.

FIG. 3 reveals that the sheathed heaters in which the content of the nickel powder is in the range of 0.1–10 wt% have almost the same insulation resistance under self-heating conditions 11 days after commencement of the continuous energizing test as the sheathed heater of sample No. 11.

FIG. 4 reveals that the sheathed heaters in which the content of the nickel powder is in the range of 0.1–10 wt% are longer in life than the known sheathed heater of sample No. 11.

Thus, the sheathed resistance heaters using electrically insulating powders 4 which had a content of nickel powder ranges from 0.1–10 wt% were found to have a relatively high level of insulation resistance under self-heating conditions after long-term use and a prolonged life.

EXAMPLE 2

An electrofused magnesia powder was used as a main component of the electrically insulating powder 4, to which were added different amounts of an electrofused cobalt powder, followed by mixing to obtain several samples of electrically insulating powders 4.

The procedure of Example 1 was subsequently repeated to fabricate sheathed resistance heaters of sample Nos. 18–23.

These sheathed resistance heaters were subjected to the measurement of the initial insulation resistance under self-heating conditions, variation in insulation resistance under self-heating conditions in relation to time, and life.

Among the results of the measurement, the initial insulation resistance under self-heating conditions, insulation resistance under self-heating conditions after 11 days and life are shown in Table 3.

Figure 5:
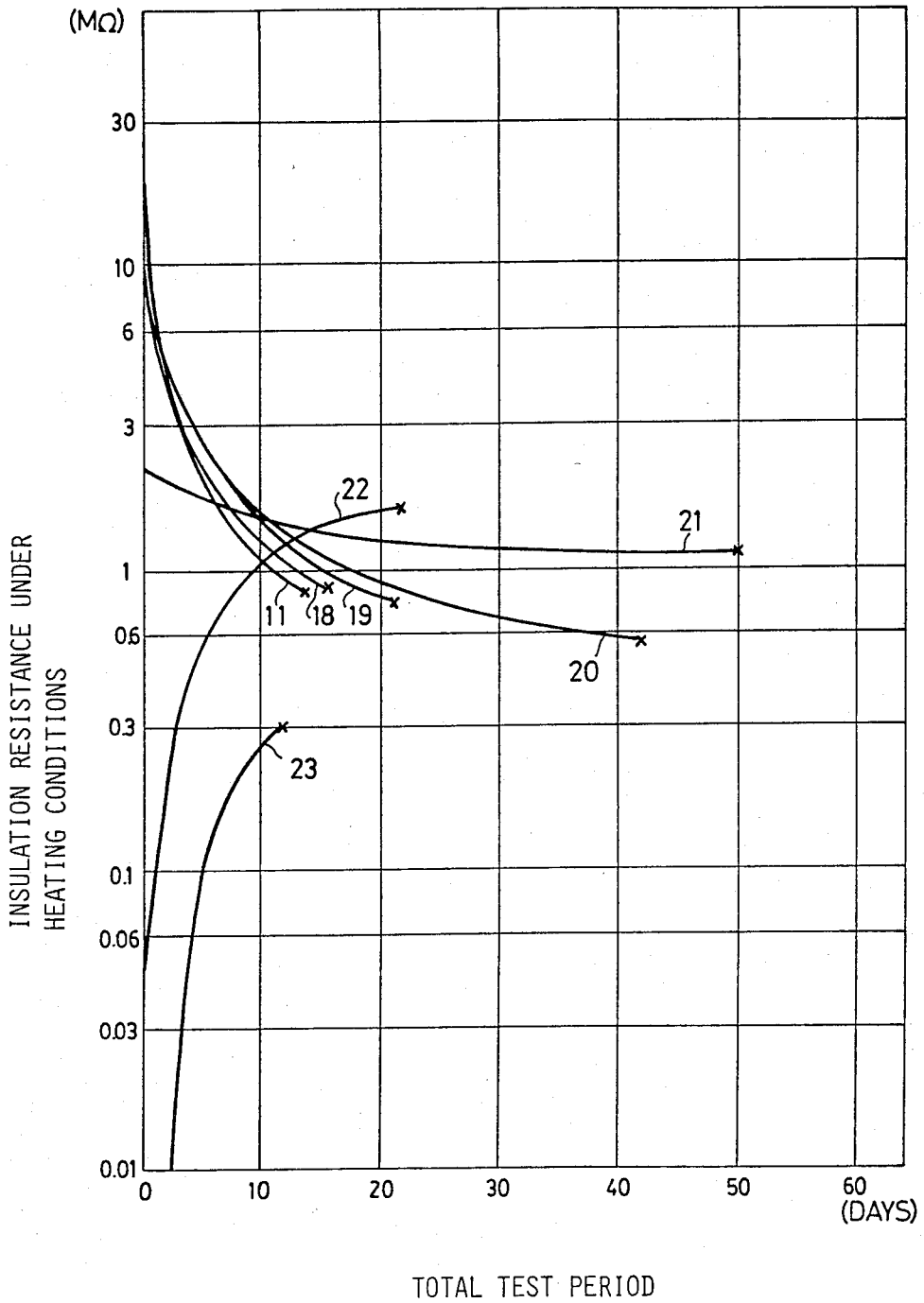
Figure 6:
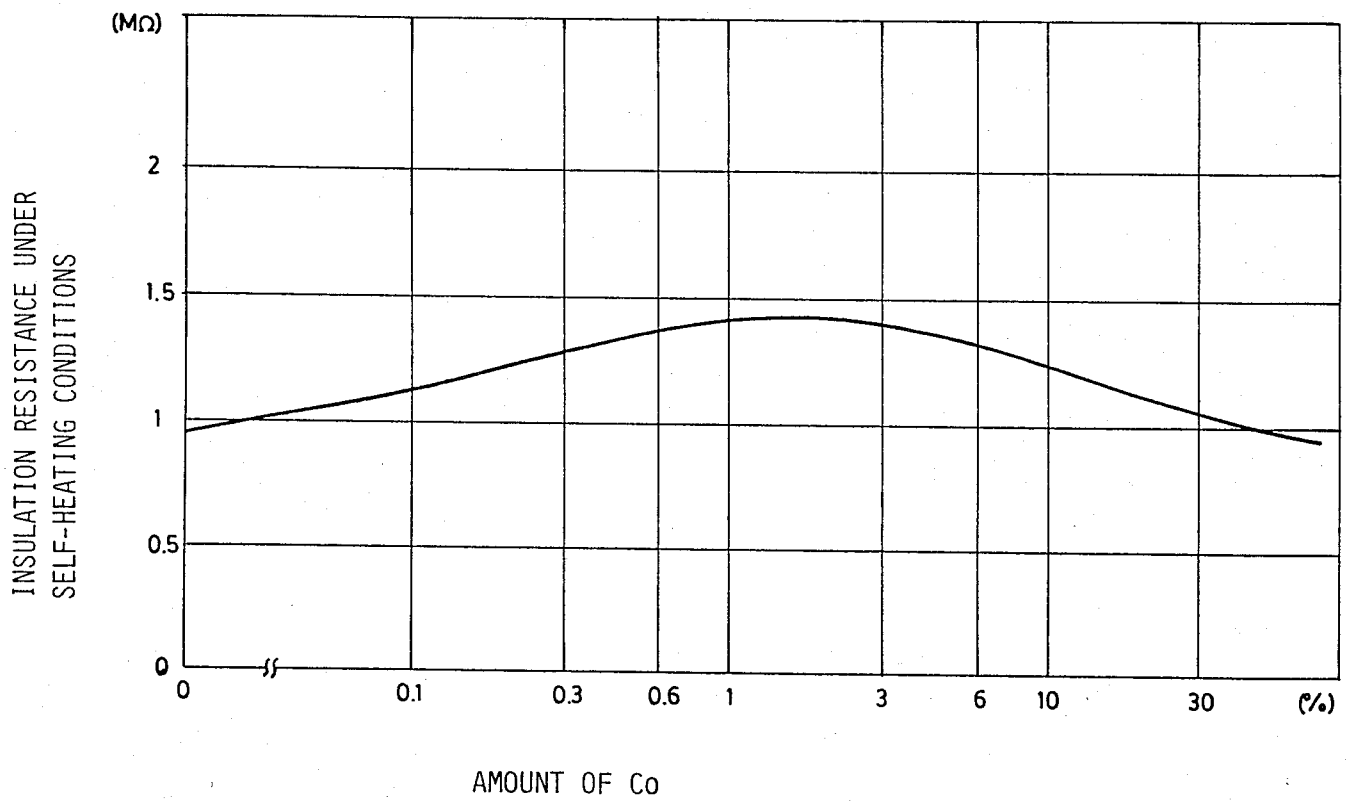
Figure 7:
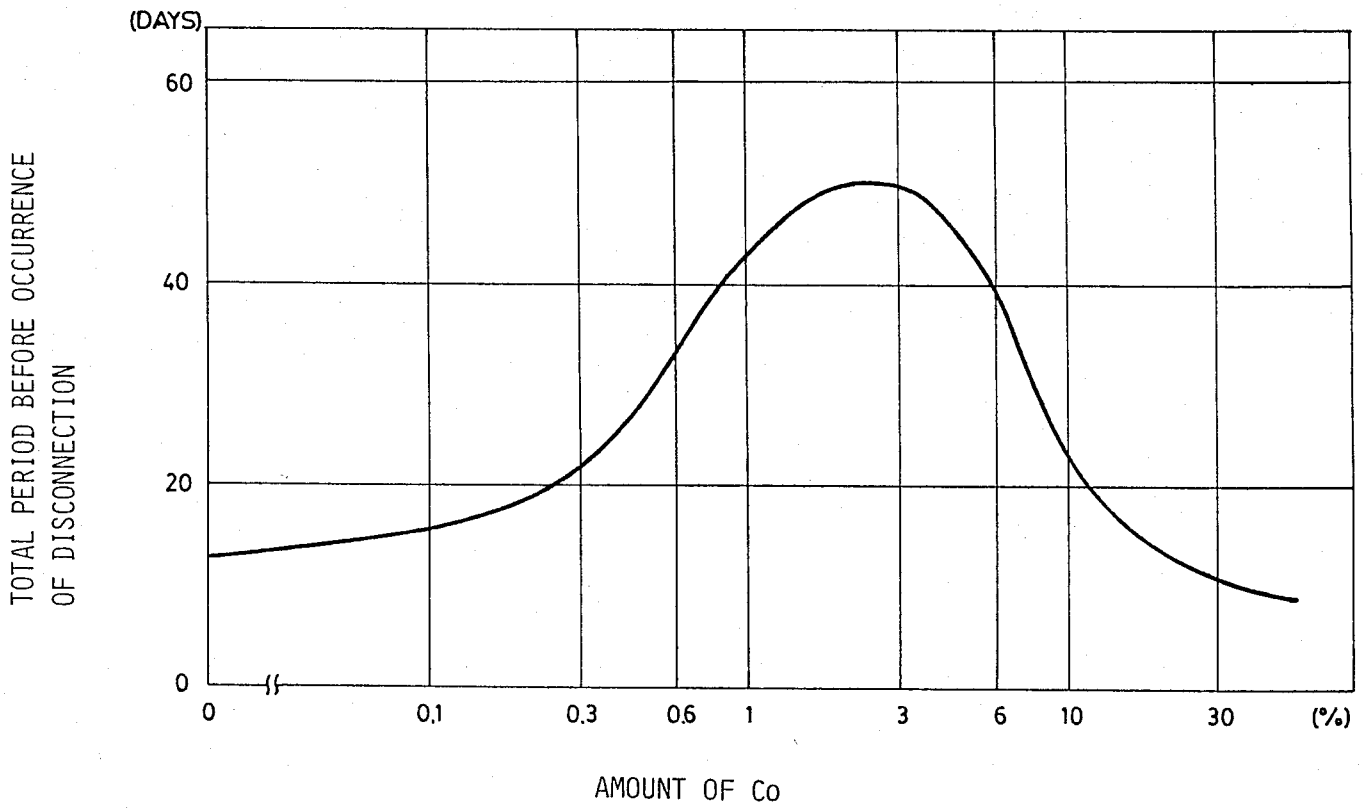

FIG. 5 shows the insulation resistance under self-heating conditions in relation to time, FIG. 6 shows the relation between the amount of cobalt powder and the insulation resistance under self-heating conditions after 11 days, and FIG. 7 shows the relation between the amount of the cobalt powder and the life.

It will be noted that curves 18–23 in FIG. 5 correspond sheathed heaters of sample Nos. 18–23, respectively.

TABLE 3

| Sample No. | Amount of Cobalt Powder (wt %) | Initial Insulation Resistance under Self-heating Conditions (Mega Ohms) | Insulation Resistance under Self-heating Conditions after 11 Days (Mega Ohms) | Life (days) |
|---|---|---|---|---|
| 11 | 0.0 | 20 | 0.95 | 13 |
| 18 | 0.1 | 12 | 1.1 | 16 |
| 19 | 0.3 | 9 | 1.2 | 21 |
| 20 | 1.0 | 7.8 | 1.4 | 42 |
| 21 | 3.0 | 2.1 | 1.4 | 50 |
| 22 | 10.0 | 0.04 | 1.2 | 22 |
| 23 | 30.0 | <0.01 | 0.28 | 12 |

As will be apparent from the results of Table 3 and FIG. 5, the sheathed heaters of sample Nos. 18–22 in which the content of cobalt powder is in the range of 0.1–10 wt% had almost the same level of insulation resistance as the known sheathed heater No. 11. The sheathed heater of sample No. 23 is so low in insulation resistance under self-heating conditions that it cannot stand practical use.

As is clearly seen from FIG. 6, the sheathed heaters which made use of the cobalt powder in amounts ranging from 0.1–10 wt% had insulation resistance values, as measured under self-heating conditions 11 days after commencement of the continuous energizing test, similar to that of the known sheathed heater No. 11.

Moreover, FIG. 7 reveals that the sheathed heaters in which the content of cobalt powder in the insulating powder ranges from 0.1–10 wt% had a longer life than the known sheathed heater of sample No. 11.

Thus, the sheathed heaters using the electrically insulating powders 4 having a cobalt powder content of 0.1–10 wt% did not lower in the insulation resistance under self-heating conditions after long-term use and had a prolonged life.

EXAMPLE 3

An electrofused magnesia powder was used as a main component of the electrically insulating powder 4 and admixed with different amounts of iron powder to obtain samples of electrically insulating powders 4.

The general procedure of example 1 was repeated to fabricate sheathed resistance heaters numbered as 23–29.

These sheathed heaters were each subjected, in the same manner as in Example 1, to the measurement of the initial insulation resistance under self-heating conditions, variation of the insulation resistance under self-heating conditions in relation to time, and life.

Some of these results including the initial insulation resistance values under self-heating conditions, insulation resistance values under self-heating conditions after 11 days, and life are shown in Table 4.

Figure 8:
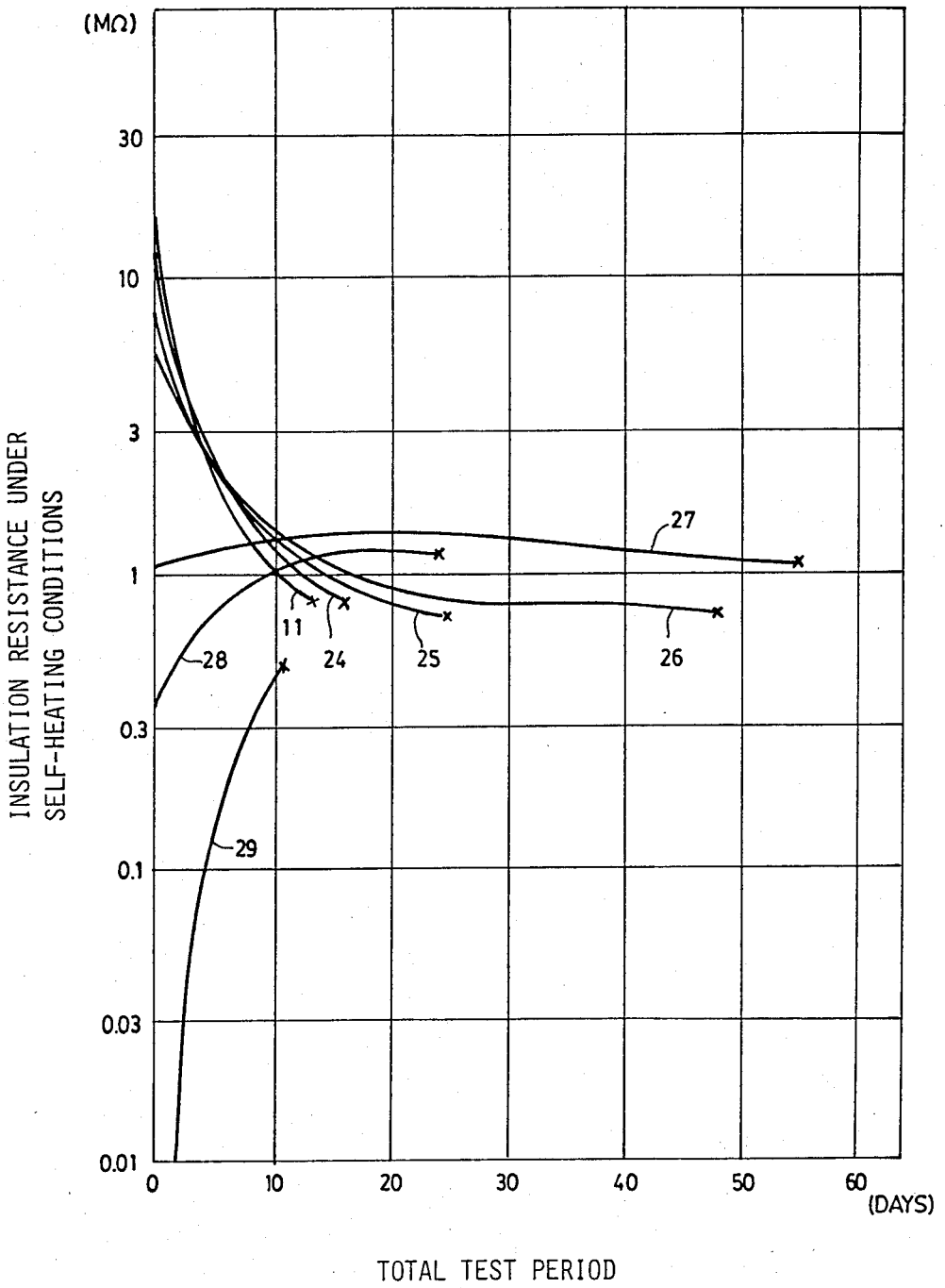
Figure 9:
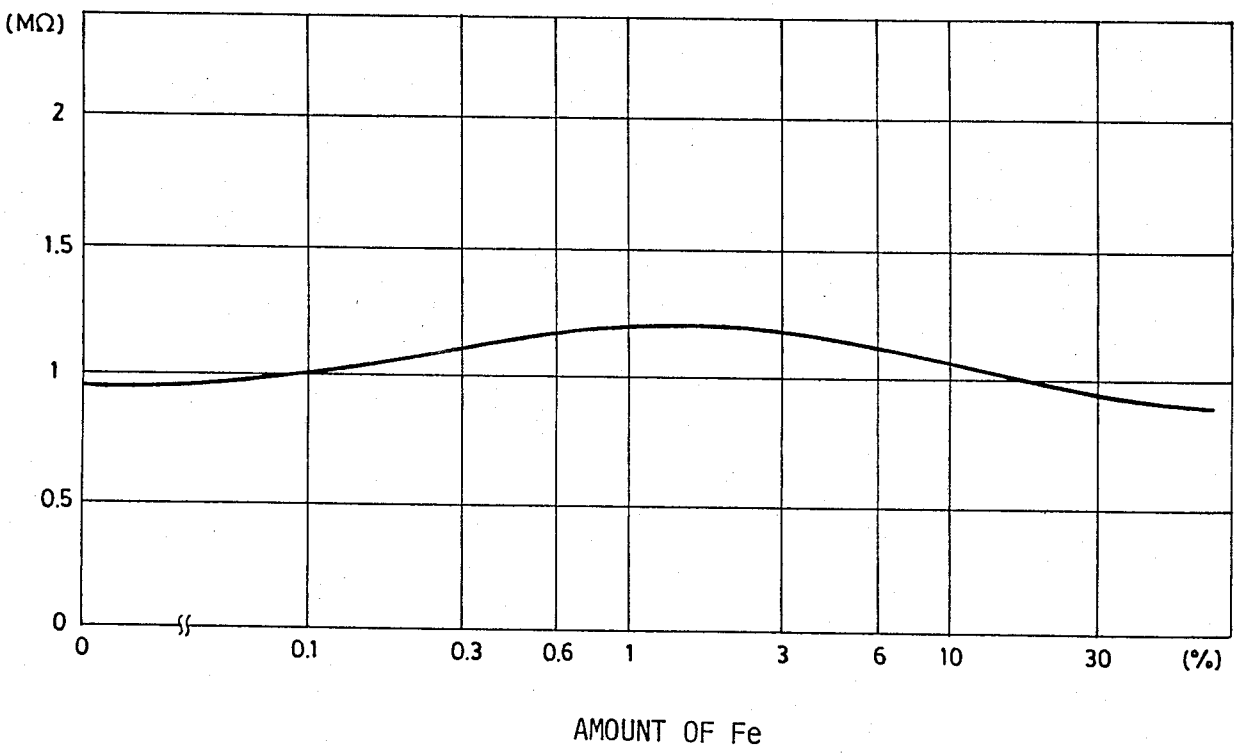
Figure 10:
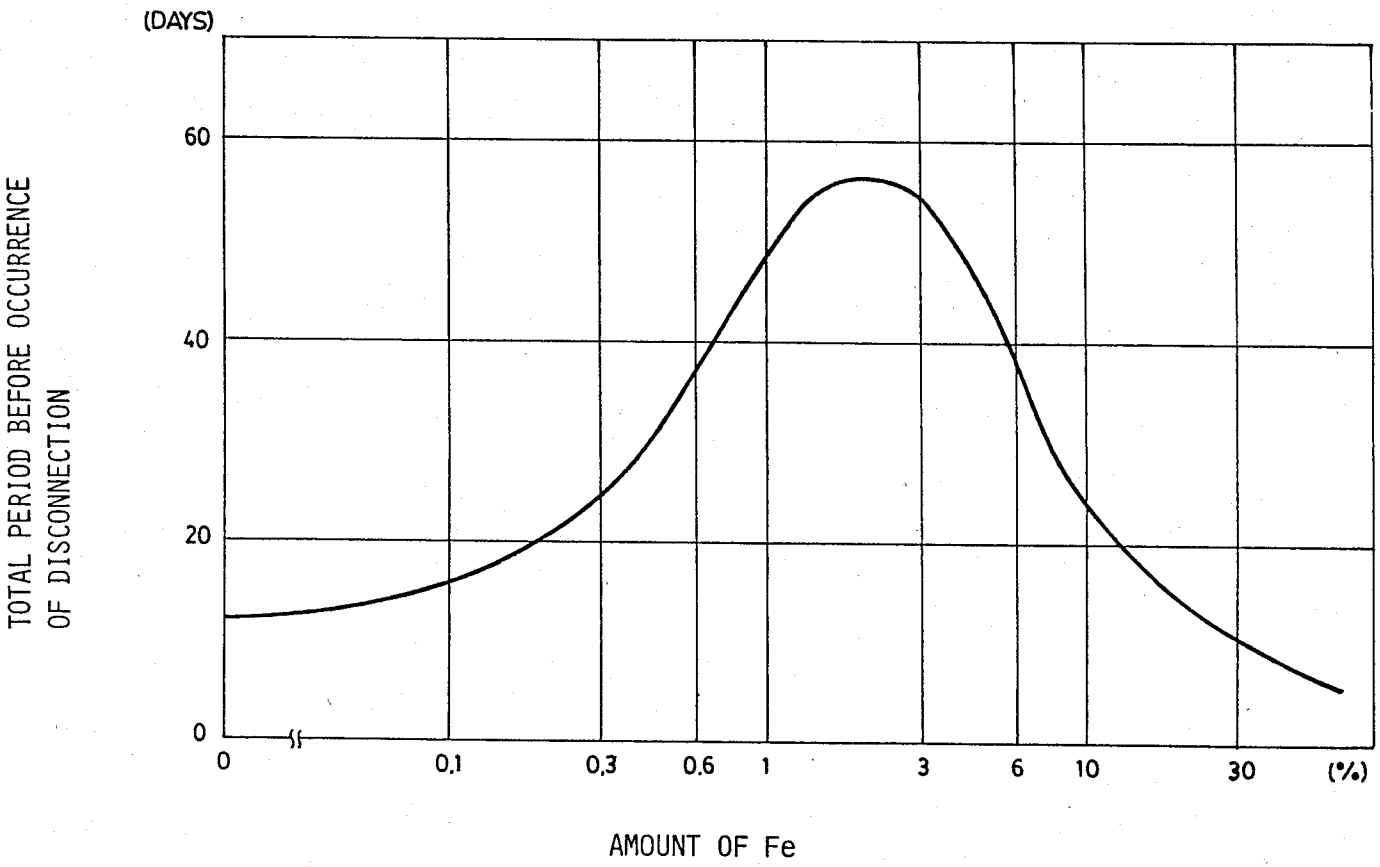

FIG. 8 shows the variation of the insulation resistance under self-heating conditions in relation to time, FIG. 9 shows the relation between the content of iron powder and the insulation resistance under self-heating conditions after 11 days, and FIG. 10 shows the relation between the content of iron powder and the life of sheathed heater.

In FIG. 8, curves 24–29 correspond to the respective sheathed heaters of sample Nos. 24–29.

TABLE 4

| Sample No. | Amount of Iron Powder (wt %) | Initial Insulation Resistance under Self-heating Conditions (Mega Ohms) | Insulation Resistance under Self-heating Conditions after 11 Days (Mega Ohms) | Life (Days) |
|---|---|---|---|---|
| 11 | 0.0 | 20 | 0.95 | 13 |
| 24 | 0.1 | 13 | 1.0 | 16 |
| 25 | 0.3 | 7.5 | 1.1 | 24 |
| 26 | 1.0 | 5.4 | 1.2 | 48 |
| 27 | 3.0 | 1.1 | 1.2 | 55 |
| 28 | 10.0 | 0.36 | 1.1 | 24 |
| 29 | 30.0 | <0.01 | 0.48 | 11 |

As is clearly seen from Table 4 and FIG. 8, the sheathed heaters of sample Nos. 24–28 which make use of the insulating powders having an iron powder content ranging from 0.1–10 wt% had almost the same insulation resistance values as the known sheathed heater No. 11. The sheathed heater of sample No. 29 was so low in the insulation resistance under self-heating conditions that it could not be served for practical applications.

FIG. 9 reveals that with the sheathed heaters in which the content of iron powder was in the range of 0.1–10 wt%, the insulation resistance values under self-heating conditions 11 days after commencement of the continuous energizing test were almost the same as that of the sheathed heater of sample No. 11.

FIG. 10 reveals that the sheathed heaters in which the content of iron powder in the insulating powders ranges from 0.1–10 wt% were longer in life than the known sheathed heater numbered as 11.

Thus, the sheathed heaters making use of electrically insulating powders 4 in which the content of iron powder ranges from 0.1–10 wt% did not lower in the insulation resistance as measured under self-heating conditions after long-term use and had a prolonged life.

EXAMPLE 4

An electrofused magnesia powder was used as a main component of the electrically insulating powder 4 and admixed with different amounts of nickel and cobalt powders to obtain samples of electrically insulating powders 4. The nickel and cobalt powders were used in equal amounts.

Subsequently, the general procedure of Example 1 was repeated to fabricate sheathed resistance heaters of sample Nos. 30–35.

Each of these heaters was subjected to the measurement of the initial insulation resistance under self-heating conditions, variation of the insulation resistance under self-heating conditions in relation to time, and life in the same manner as in Example 1.

Some of these results are shown in Table 5 including the initial insulation resistance values under self-heating conditions, insulation resistance values under self-heating conditions after 11 days of the continuous energizing test, and life.

Figure 11:
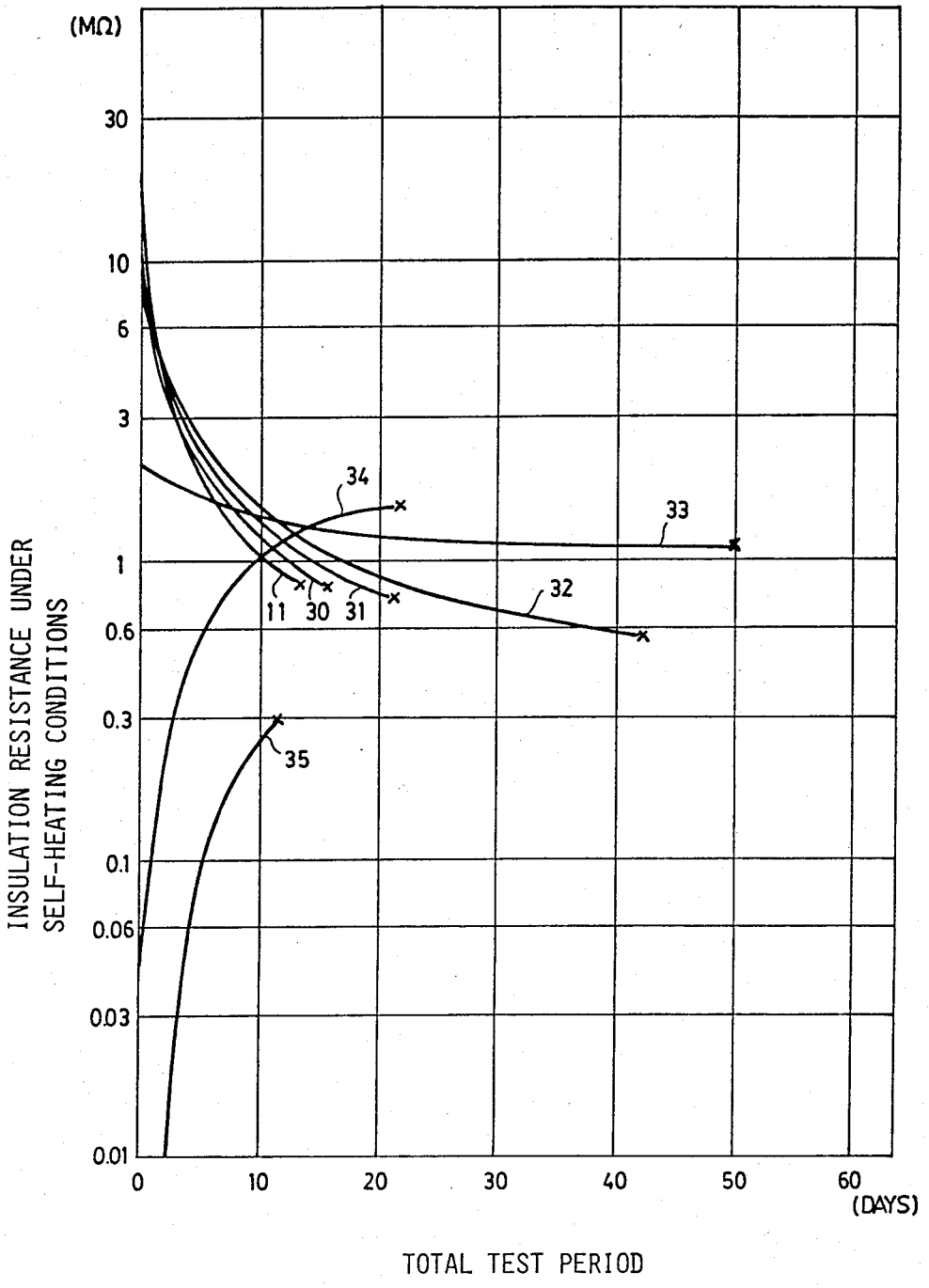
Figure 12:
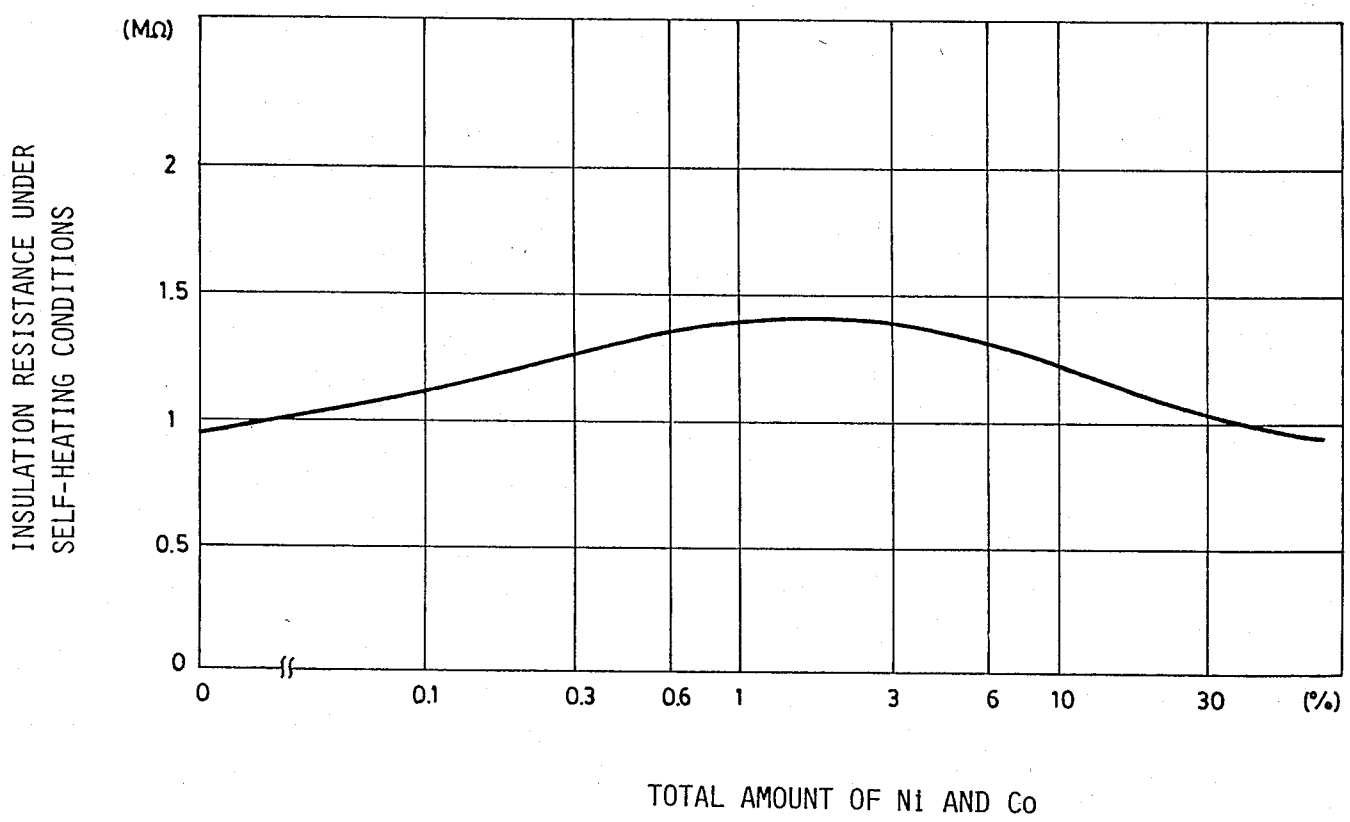
Figure 13:
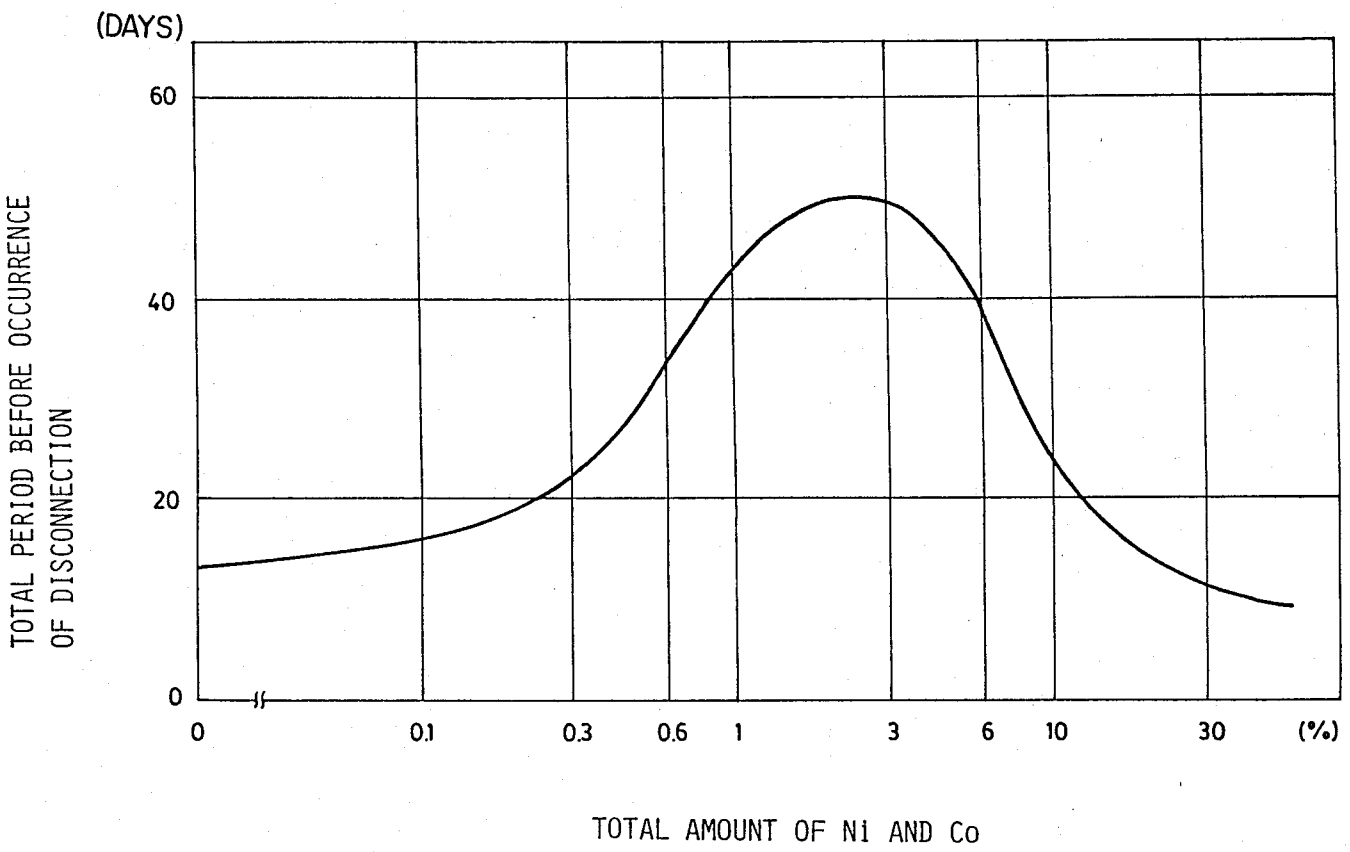

FIG. 11 shows the variation of the insulation resistance under self-heating conditions in relation to time. FIG. 12 shows the relation between the total amount of the nickel and cobalt powders and the insulation resistance under self-heating conditions after 11 days. In FIG. 13, there is shown the relation between the total amount of the cobalt and nickel powders and the life.

In FIG. 11, curves 30–35 correspond to the sheathed heaters of sample Nos. 30–35, respectively.

TABLE 5

| Sample No. | Total Amount of Nickel & Cobalt Powders (wt %) | Initial Insulation Resistance under Self-heating Conditions (Mega Ohms) | Insulation Resistance under Self-heating Conditions after 11 Days (Mega Ohms) | Life (Days) |
|---|---|---|---|---|
| 11 | 0.0 | 20 | 0.95 | 13 |
| 30 | 0.1 | 12 | 1.1 | 16 |
| 31 | 0.3 | 8.8 | 1.2 | 21 |
| 32 | 1.0 | 7.9 | 1.4 | 41 |
| 33 | 3.0 | 2.0 | 1.4 | 50 |
| 34 | 10.0 | 0.04 | 1.2 | 21 |
| 35 | 30.0 | <0.01 | 0.28 | 12 |

As will be clearly seen from table 5 and FIG. 11, the sheathed heaters numbered as 30–34 in which the total amount of the nickel and cobalt powders are in the range of 0.1–10 wt% had almost the same insulation resistance as the known sheathed heater of sample No. 11. The sheathed heater of sample No. 35 was so low in insulation resistance under self-heating conditions that it could not be used.

As will be clearly seen from FIG. 12, the sheathed heaters in which the nickel and cobalt powders were used in total amounts ranging from 0.1–10 wt% had almost the same level of the insulation resistance, as measured under self-heating conditions 11 days after commencement of the continuous energizing test, as the known sheated heater No. 11.

FIG. 13 reveals that the sheathed heaters in which there were used nickel and cobalt powders in total amounts ranging from 0.1–10 wt% showed a longer life than the known sheathed heater of sample No. 11.

As will be understood from the above results, the sheathed heaters making use of electrically insulating powders 4 which had a total amount of cobalt and nickel powders of 0.1–10 wt% did not lower in the insulation resistance as measured under self-heating conditions after long-term use and had a prolonged life.

In the above examples, nickel, cobalt and iron were used as a metallic powder being added and similar results were obtained when niobium, tungsten and yttrium are used instead of the above-mentioned metals.

In Examples 1–4, the electrofused magnesia powder was used as a main component of the electrically insulating powder, and a similar tendency was shown when electrofused alumina and silica powders were used instead of the electrofused magnesia powder.

The characteristics of the sheathed heater may, more or less, vary depending on the kind of the electrofused magnesia powder. For instance, use of an electrofused magnesia powder having a high specific resistance results in a higher insulation resistance of sheathed heater and use of an electrofused magnesia powder of high purity showing a relatively long life results in a longer life of sheathed heater.

Although the nichrome wire of the first kind was used as the heating wire 2, other wire materials indicated in Table 6 may be likewise used with similar results. As regards the metallic pipe 3, use of other metals or alloys indicated in Table 7 produces similar results.

TABLE 6

| Kind | | Chemical Composition (%) | | | | | | |
|---|---|---|---|---|---|---|---|---|
| | | Ni | Cr | C | Si | Mn | Fe | Al |
| Nichrome Wire | First Kind | over 77 | 19–21 | below 0.15 | 0.75–1.5 | below 2.5 | below 1 | — |
| | Second Kind | over 57 | 15–18 | below 0.15 | 0.75–1.5 | below 1.5 | balance | — |
| Iron-Chromium-Aluminium Wire | First Kind | — | 23–26 | below 0.10 | below 1.5 | below 1.0 | balance | 4–6 |
| | Second Kind | — | 17–21 | below 0.10 | below 1.5 | below 1.0 | balance | 2–4 |

TABLE 7

| Kind | | Chemical Composition (%) | | | | | | | | | |
|---|---|---|---|---|---|---|---|---|---|---|---|
| | | C | Si | Mn | P | S | Ni | Cr | Fe | Cu | Al |
| Stainless Steel | SUS304 | below 0.08 | below 1.00 | below 2.00 | below 0.04 | below 0.03 | 8.00~ 10.50 | 18.00~ 20.00 | balance | — | — |
| | SUS321 | below 0.08 | below 1.00 | below 2.00 | below 0.04 | below 0.03 | 9.00~ 13.00 | 17.00~ 19.00 | balance | — | — |
| | SUS316L | below 0.03 | below 1.00 | below 2.00 | below 0.04 | below 0.03 | 12.00~ 15.00 | 16.00~ 18.00 | balance | — | — |
| Corrosion and Heat Resistant Super Alloys | NCF1P (Inconery 600) | below 0.15 | below 0.50 | below 1.00 | below 0.030 | below 0.015 | over 72.00 | 14.00~ 17.00 | 6.00~ 10.00 | below 0.50 | |
| | NCF2P (Incoroi 800) | below 0.10 | below 1.00 | below 1.50 | below 0.030 | below 0.015 | 30.00~ 35.00 | 19.00~ 23.00 | balance | below 0.75 | 0.15 0.60 |

In Examples 1–4, the heaters were tightly sealed with the low melting glass 5 and the heat-resistant resin 6 but a similar tendency was shown even though the heaters were not sealed.

The sheathed resistance heat of the present invention is not limited to the design shown in FIG. 1 and may include those called a cartridge heater and a glow plug.

INDUSTRIAL UTILIZABILITY

As described hereinabove, according to the present invention, there can be obtained a sheathed resistance heater of a long life by using an electrically insulating powder admixed with 0.1–10 wt% of at least one metallic powder selected from the group consisting of those of nickel, cobalt, iron, niobium, tungsten and yttrium.

We claim:

1. A sheathed resistance heater comprising an electrical metal heating wire received in a metal pipe, and an electrically insulating powder composition filling the remainder of the metal pipe, said insulating power composition comprising at least one electrically insulating powder uniformly mixed with at least one metallic powder selected from the group consisting of nickel, cobalt, iron, niobium, tungsten and yttrium, so that said heating wire is insulated from said metal pipe by said insulating powder composition and said at least one metallic powder suppresses the evaporation of metal components in the heating wire.

2. A sheathed resistance heater according to claim 1, wherein said at least one metal powder is added in an amount of 0.1–10 wt%.

3. A sheathed resistance heater comprising an electrical metal heating wire received in a metal pipe, and an electrically insulating powder composition filling the remainder of the metal pipe, said insulating powder composition comprising a uniform mixture of an electrically insulating powder containing about 0.1 to 10 weight percent of at least one metallic powder additive selected from the group consisting of nickel, cobalt, iron, niobium, tungsten and yttrium, so that said heating wire is insulated from said metal pipe by said insulating powder composition and said at least one metallic powder suppresses the evaporation of metal components in the heating wire.

4. A sheathed resistance heater according to claim 3, wherein said electrically insulating powder is magnesia powder.

5. A sheathed resistance heater according to claim 3, wherein said metal pipe has sealed ends.

* * * * *